US005083355A

United States Patent [19]

Dacey, Jr.

[11] Patent Number: 5,083,355

[45] Date of Patent: Jan. 28, 1992

[54] HEMMING APPARATUS

[75] Inventor: Ernest A. Dacey, Jr., Highland, Mich.

[73] Assignee: Utica Enterprises, Inc., Shelby Township, Macomb County, Mich.

[21] Appl. No.: 516,930

[22] Filed: Apr. 30, 1990

[51] Int. Cl.[5] ..... B21D 5/00; B21D 29/03

[52] U.S. Cl. ..... 29/243.58; 72/319; 72/323; 72/450

[58] Field of Search ..... 72/312-315, 72/319, 323, 450; 29/243.58, 243.57

[56] References Cited

U.S. PATENT DOCUMENTS 2,569,181 9/1951 Laxo ..... 72/312
3,058,512 10/1962 Chebuhar ..... 72/312
3,191,414 6/1965 Kollar et al. ..... 72/48
3,276,409 10/1966 St. Denis ..... 72/48
4,411,148 10/1983 Aschauer ..... 72/319
4,484,467 11/1984 Kitano et al. ..... 72/379.2
4,706,489 11/1987 Dacey, Jr. ..... 72/450

*Primary Examiner*—Daniel C. Crane
*Attorney, Agent, or Firm*—Remy J. VanOphem

[57] ABSTRACT

An apparatus and method for forming a hem on an edge of a sheet metal member including an anvil attached to a columnar support structure that also includes a cantilevered bracket that is the support for a movable hemmer bracket to which a hemming steel is attached. By the utilization of a pair of crank arms, the hemmer bracket is movable through a plurality of arcuate paths which permits the hemming steel to perform multiple forming operations on a workpiece held by the anvil. The method includes the steps of partially hemming a sheet metal member, then disengaging the hemming steel contact with the workpiece, then moving the hemming steel to a new location before recontacting the workpiece with the hemming steel.

25 Claims, 8 Drawing Sheets

HEMMING APPARATUS

BACKGROUND OF THE INVENTION

1. Field of the Invention

The present invention relates to a hemming apparatus and method for forming a hem on an edge of a sheet metal member and, more particularly, the invention relates to the forming of a hem on an edge of a structural sheet member such as an automobile body panel or similar multipart structure.

2. Description of the Prior Art

Sheet metal folding or hemming is a technique that has gained widespread use in many industries including the automotive industry. Hemming is utilized to form a piece of metal that serves as a reinforcing element for external automobile components such as doors and hoods. For example, the trunk lid for most automobiles is of two-piece construction in which the outer edge of the exterior element of the trunk lid is folded over against the outer edge of an inner reinforcing element by a hemming process.

The hemming procedures, as described in the prior art, utilize an outer element with the outer edge prefolded in the form of a flange to lie nearly perpendicular to the main portion of the outer element. Such preforming is most conveniently done in the stamping operation, that is, customarily utilized in the forming of such outer element. The hemming of such flange requires that it be folded over from such prefolded condition at approximately a right angle to be against the outer edge of the inner element after the inner element has been placed inside the upturned flange of the outer element. The folding over or hemming of the flange of the outer element in many hemming processes of the prior art is accomplished in multiple stages, usually in two stages. In a first stage, force was applied generally perpendicular to the original orientation of the flange to cause it to bend a considerable angle from its original orientation in which a second stage force was applied generally parallel to the original orientation of the flange to cause the partially bent flange to bend an additional amount to complete the folding of the flange from its prefolded condition to securely engage the outer edge of the inner element of the two piece structure that was being hemmed. Such two stage hemming process is done in separate sets of tools and the required tooling for such an operation is rather massive, costly, and space consuming. Additionally, a two stage hemming process requires a transfer operation to transfer the workpiece that is being hemmed from the first stage tooling to the second stage tooling. Such a transfer operation, which is generally synchronized, involves special transfer equipment and poses additional risks of equipment malfunction which can lead to interruptions on the production line. Multiple stage hemming operations of the aforesaid type also require for process consideration a certain minimum depth of flange in the outer edge flange of the outer element that exceeds the depth of the flange that would otherwise be required based on the product requirements of the component that is being hemmed. Then, too, the finished component is more costly and has a greater weight than would otherwise be necessary.

The present invention differs from the hemming tool that is shown and described in U.S. Pat. No. 4,706,489 entitled "Single Station Hemming Tool" issued Nov. 17, 1987 to Ernest A. Dacey, Jr. The hemming tool set forth in the above referenced patent utilizes a plurality of similar hemming tools that are spaced strategically around the perimeter of an automobile panel component. Each one of the hemming tools is similar in construction and is activated by a common actuator. The hemming tool has a flange contacting member and through a system of cams and levers the flange contacting tooling is initially driven generally perpendicular of the flange with respect to the original orientation of the flange of the outer element to accomplish a first stage hemming or prehemming of such flange and is subsequently driven generally parallel to the original orientation of the flange to complete the hemming or folding of the flange. As the hemming tool approached the flange of the component to be hemmed, the tool traveled along a first elliptical path, then a second elliptical path was utilized to complete the hemming operation. The mechanism for driving the hemming tool through a path with two elliptically arcuate portions included a cam that moved the center of movement of the hemming tooling from the center of the first ellipse to the center of the second ellipse at a predetermined point in the movement of the hemming tool that corresponds to the completion of the first elliptically arcuate movement. In order to accomplish the aforesaid compound elliptical movement, there was a heavy reliance upon a complicated cam and cam follower arrangement that was difficult to keep in adjustment and also was prone to unacceptable wear. The present invention does not use the cam system taught in the above referenced patent. Also, the present invention provides a greater freedom of movement of the tooling than what is described in U.S. Pat. No. 4,706,489.

The advantages of performing an entire hemming operation in a single stage is recognized in U.S. Pat. No. 3,276,409 entitled "Assembly Machine" issued Oct. 4, 1966, to Edouard R. St. Denis. This patent shows a hemming structure that employs several like units spaced around the periphery of a panel component that is to be hemmed. A pair of fluid driven cylinders is employed to drive the hemming tool of each unit toward the upstanding portion of an outer panel flange that is to be crimped or hemmed. The tooling first contacts the upstanding panel flange near the free end of the flange. The flange is then bent to nearly half of its final bend. The tooling then slides over and downward upon the already bent flange in order to hem the outer panel into tight engagement with the inner panel. At no time did the tooling leave contact with the outer panel flange, thus, undesirable stretching of the panel material was a distinct possibility. In the present invention, the tooling performs an initial bend then reorients itself remote from the flange before performing the final hemming step.

A somewhat similar hemming machine is shown and described in U.S. Pat. No. 3,191,414 entitled "Hemming Machine or Fixture" issued June 29, 1965, to James A. Kollar et al. The Kollar et al machine utilizes two fluid driven cylinders to move the hemming steel in a direction toward the anvil. The workpiece is placed on the anvil with the outer panel of the workpiece already bent to approximately a right angle. Through the action of one fluid driven cylinder, the hemming steel moves generally parallel to the surface of the anvil thus causing an additional bending of the upstanding flange to an acute angle configuration. The second fluid driven cylinder then causes the hemming steel to move toward the anvil surface thus completing the hemming operation. At no time does the hemming steel leave contact with the flange of the workpiece. The continuous contact of the tooling with the workpiece can in some instances produce undesirable stretch marks in the workpiece. The present invention is an improvement over the just cited art in that the hemming steel is completely reoriented after it makes initial contact with the workpiece.

In U.S. Pat. No. 4,484,467 entitled "Beaded Edge Forming Method and Apparatus" issued Nov. 27, 1984, to Mikio Kitano et al, there is set forth a method of hemming the flange of a workpiece. The method involves essentially two deforming steps. First, a deforming tool is moved vertically downward toward an upstanding workpiece flange, the downward tool movement deforms the flange until it is partially bent, and the deforming tool is then moved out of contact with the workpiece flange. Second, a hemming tool is moved into position above the partially bent flange of the workpiece, the hemming tool is lowered vertically against the workpiece flange thus crimping it into final position, and the hemming tool contacts only the outer portion of the workpiece flange thus preserving a previously formed bead at the base of the workpiece flange. The present invention employs a method that causes the hemming tool to disengage itself from contact with the workpiece, however, only one hemming tool is used whereas the method set forth in U.S. Pat. No. 4,484,467 requires two separate tools in order to perform the hemming method.

SUMMARY OF THE INVENTION

The invention sets forth a method of and an apparatus for hemming an outer peripheral flange of an outer sheet metal element of a multiple element panel assembly to overlie the outer edge of an inner element of such panel assembly. The flange of the outer sheet metal is moved from an original position that is generally perpendicular with respect to the inner portion of the assembly. The entire hemming operation is performed at a single station without the need for the transfer of the assembly to another work station. The hemming apparatus has an anvil and a juxtaposed hemming steel that act in conjunction with one another to effect the hemming operation through a system of shafts and lever arms.

The invention includes a support structure of upright configuration that is mounted on a support plate that is oriented in a generally horizontal attitude. The support structure supports an anvil through a pair of cantilevered arms. It also supports a hemmer bracket that can swing arcuately into and out of engagement with the anvil. The hemming steel is attached to the hemmer bracket and its movement is controlled by moving the hemmer bracket bidirectionally under the influence of a lower eccentrically mounted shaft that is coupled to a crank arm. The top portion of the hemmer bracket is moved toward and away from the anvil by the linking together of a plurality of crank arms coupled between the support structure and the hemmer bracket. The crank arms are operated by a linear motion device well known in the art. Because of the manner in which the hemming steel of the present invention contacts the flange of the outer element of the workpiece, the final positioning of the flange can be controlled in a manner heretofore not possible by a single station hemming apparatus. The complete hemming of a flange at a single work station helps to reduce the cost and in some instances the weight of the assembly that is being fabricated.

The movement of the hemming steel of the present invention, in the case of hemming generally horizontally positioned metallic components, the outer component or element having a flange to be folded over by the hemming tool from a generally vertically extending original position to a generally horizontal final position, involves a sequence of arcuate motions which, respectively, approximate horizontal and vertical motions. The first of such motions follows an arcuate path which brings the hemming steel into contact with the upstanding flange of the outer element. The outer element is thus partially bent over to form an acute angle of approximately 45 degrees. The hemming steel then backs off from contact with the partially bent outer element and then advances to a position more directly over the flange of the outer element. The advancement of the hemming steel to its new position over and adjacent to the partially bent flange of the outer element is achieved through an arcuate movement of the hemming steel. Once the hemming steel has reached its position above and remote from the flange of the outer element, the hemming steel then moves arcuately toward the flange, makes contact, and continues such arcuate travel until the outer flange has achieved its final crimped position. Through a series of arcuate movements, the hemming steel is moved upward and outboard of the hemmed component, enabling it to be removed from the apparatus.

Thus, it is an object of the present invention to provide an improved method and apparatus for assembling an inner element to an outer element by hemming at a single station.

A primary object of the present invention is to provide a hemming apparatus that can perform multiple hemming steps with the same hemming steel at the same work station.

Another object of the present invention is to provide an apparatus that is compact and can be actuated with other like and adjacently positioned units by a common power source.

A further object of the present invention is to provide an apparatus that can perform a metal hemming operation with a minimum of drag and marring of the workpiece.

An additional object of the present invention is to power the hemming apparatus through a plurality of linearly applied reversible forces.

Another object of the present invention is to provide an apparatus in which the hemming steel is supported by a bracket that can undergo arcuate movement in more than one direction.

A further object of the present invention is to provide a method for the hemming of a metallic flange in which the hemming steel is moved into and out of contact with the metallic flange a plurality of times.

Still another object of the present invention is to provide an apparatus that permits a variation in the sequence in which the hemming steel is manipulated in the vicinity of the workpiece.

Other objects and advantages of this invention will be more apparent after a reading of the following detailed description taken in conjunction with the drawings provided.

DETAILED DESCRIPTION OF THE PREFERRED EMBODIMENT

Figure 1:
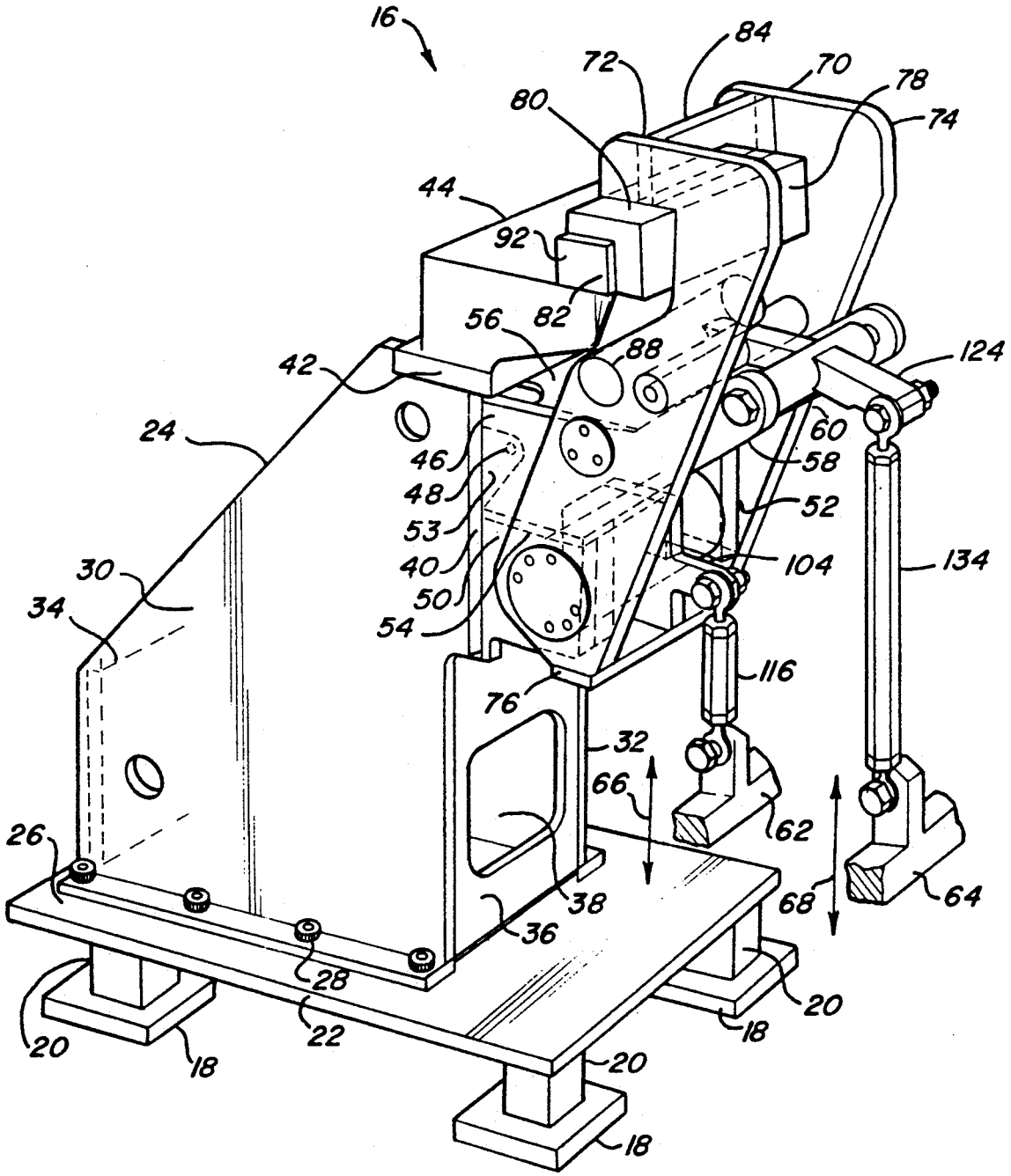
FIG. 1 is a perspective view that shows one of several like units that can be placed adjacent to one another and supplied with power from a common source.

Referring now to the drawings and more particularly to FIG. 1, there is illustrated in perspective an overall apparatus 16 for the hemming of, for example, the door of an automobile. The overall apparatus 16 is but one of a series of similar hemming devices that surround a panel that is to be hemmed. All of the similar hemming devices can be operated simultaneously from a common power source as is well known in the prior art. The overall apparatus 16 is used to perform a process of sheet metal bending that is generally described as a hemming process to join a pair of sheet metal parts. The outer part is generally that portion of the workpiece that subsequently supports a painted surface. Consequently, the surface of the outer part must be as free as possible from tooling marks. The outer part is generally prepared for the hemming operation by creating around its peripheral edge an upstanding flange that is approximately perpendicular to the panel portion of the outer part. This configuration of the outer part permits the inner part to be nested within the confinement of the upturned flange of the outer part.

The overall apparatus 16 requires a substantial support such as a series of base pads 18. Each one of the base pads 18 has an upstanding support column 20 affixed thereto. A rigid base plate 22 spans the distance between the upstanding support columns 20. The base plate 22 is preferably welded to the tops of the support columns 20, however, bolts could also be utilized. A columnar bracket 24 is attached to a top surface 26 of the base plate 22 by a series of spaced apart bolts 28. The columnar bracket 24 is of welded construction that is stress relieved and machined to the final required dimensional tolerances. A pair of spaced apart side plates 30 and 32 support the vertical loads attributable to the remainder of the upper structure of the overall apparatus 16. The side plates 30 and 32 are stabilized by a rear plate 34 and a lower front plate 36 that contains an aperture 38 therethrough. A top front plate 40 spans the distance between the side plates 30 and 32. An anvil support plate 42 is horizontally disposed and attached to the top of the side plates 30 and 32 as well as the upper edge of the top front plate 40. An anvil 44 is attached to the anvil support plate 42 by a series of heavy duty bolts (not shown). The anvil 44 is quite massive so that it will hold its contoured top surface without deforming under repetitive loading during the operation of the overall apparatus 16. In addition to the anvil 44, the columnar bracket 24 has attached thereto a cantilevered bracket 46. The cantilevered bracket 46 is attached to the top front plate 40 by a series of bolts 48. The cantilevered bracket 46 is also of welded construction with a pair of vertical side plates 50 and 52 arranged in spaced apart parallel orientation. The cantilevered bracket 46 has a back plate 53 which abuts the top front plate 40. The bolts 48 pass through the back plate 53 and are tapped into the top front plate 40 of the columnar bracket 24. The cantilevered bracket 46 has a horizontally positioned intermediate plate 54 and a top plate 56. The cantilevered bracket 46 also has a pair of upwardly extending arms 58 and 60 which provide support for several components of the present invention which will be discussed hereinbelow.

As can be viewed in FIG. 1, the overall apparatus 16 is rather narrow in width so that another like unit can be placed adjacent thereto. The overall apparatus 16 and like units are powered by a ring like structure that circumscribes all of the units. Segments of two such ring structures 62 and 64 are shown in FIG. 1. The ring structure 62 moves along a vertical path designated by the numeral 66. Likewise, the ring structure 64 moves along a vertical path 68. The ring structures 62 and 64 can be actuated by any well known power source such as fluid driven cylinders (not shown).

Figure 2:
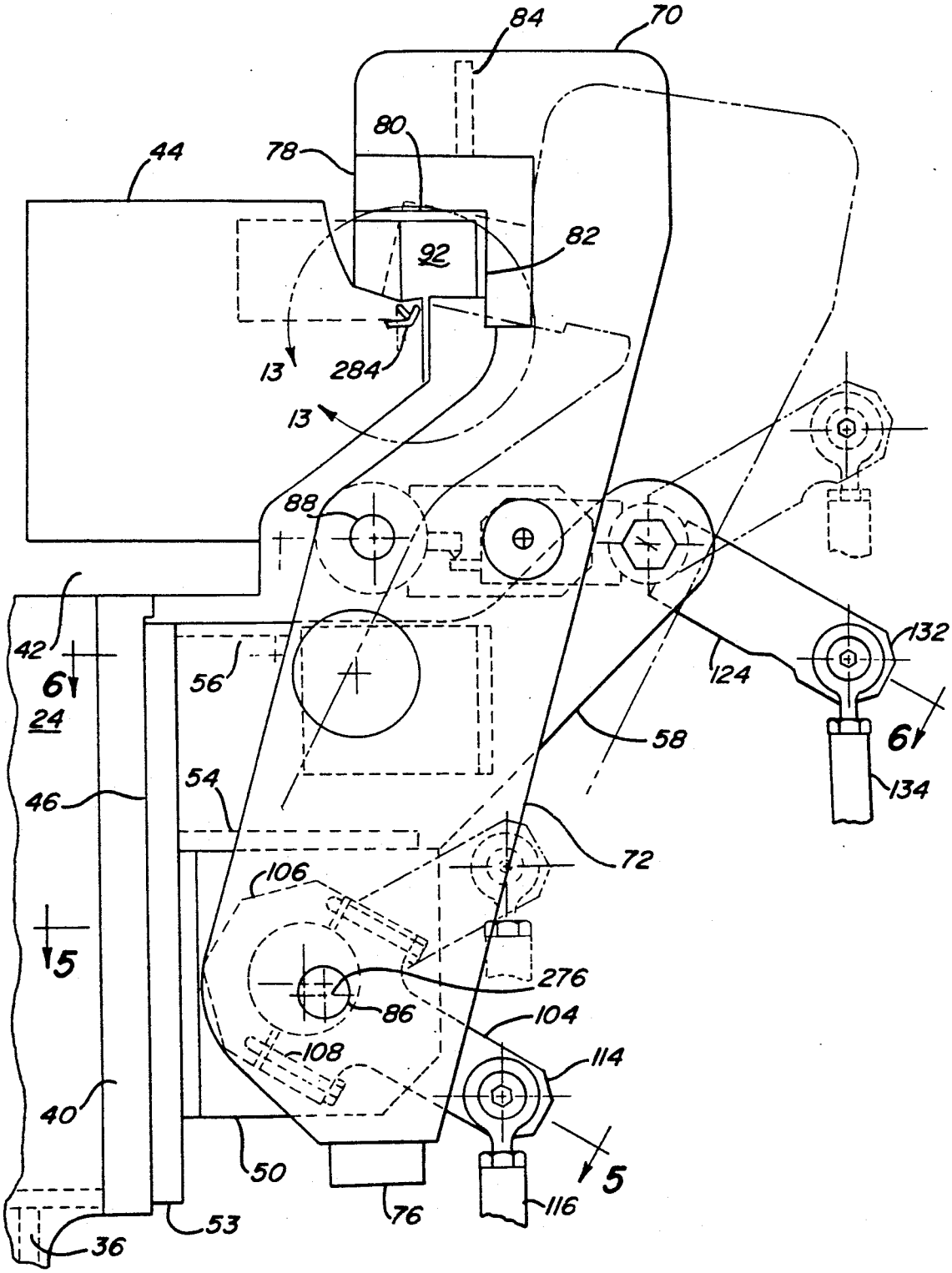
FIG. 2 is an elevational side view of the invention that shows part of the support structure for the anvil and the hemming steel.

FIG. 2 is an elevational side view of the present invention that depicts a portion of the columnar bracket 24 with the anvil 44 mounted thereon. Also shown is a side view of the cantilevered bracket 46 which is attached to the columnar bracket 24. A hemmer bracket 70 is supported by the cantilevered bracket 46. The hemmer bracket 70 is similar to a box in configuration. Two vertically oriented elongate plates 72 and 74 are arranged in spaced apart parallel orientation. The elongate plates 72 and 74 are coupled together at the bottom by a cross bar 76 which is attached preferably by welding. The top section of the hemmer bracket 70 is immobilized by an L-shaped cross member 78 which is also welded firmly to the elongate plates 72 and 74. A pair of spacers 80 and 82 are positioned against the reentrant surfaces of the L-shaped cross member 78. An additional cross plate 84 is positioned adjacent to the L-shaped cross member 78 and tied into the elongate plates 72 and 74. The hemmer bracket 70 is held in position on the overall assembly 16 by essentially four support points. The two lower support points are provided by the ends of an eccentric shaft 86 which is journaled in the walls of the elongate plates 72 and 74. The two upper support points are provided by support shafts 88 and 90. As will be described in more detail below, the hemmer bracket 70 can be moved to a limited extent in all except lateral directions. In particular, the hemmer bracket 70 is heavily reinforced at its top end by the L-shaped cross member 78 and the cross plate 84 to help resist the deflection that occurs when the hemming steel 92 is biased against the anvil 44. The hemmer bracket 70 straddles the cantilevered bracket 46 with the elongate plates 72 and 74 lying outboard of the upwardly extending arms 58 and 60.

Figure 3:
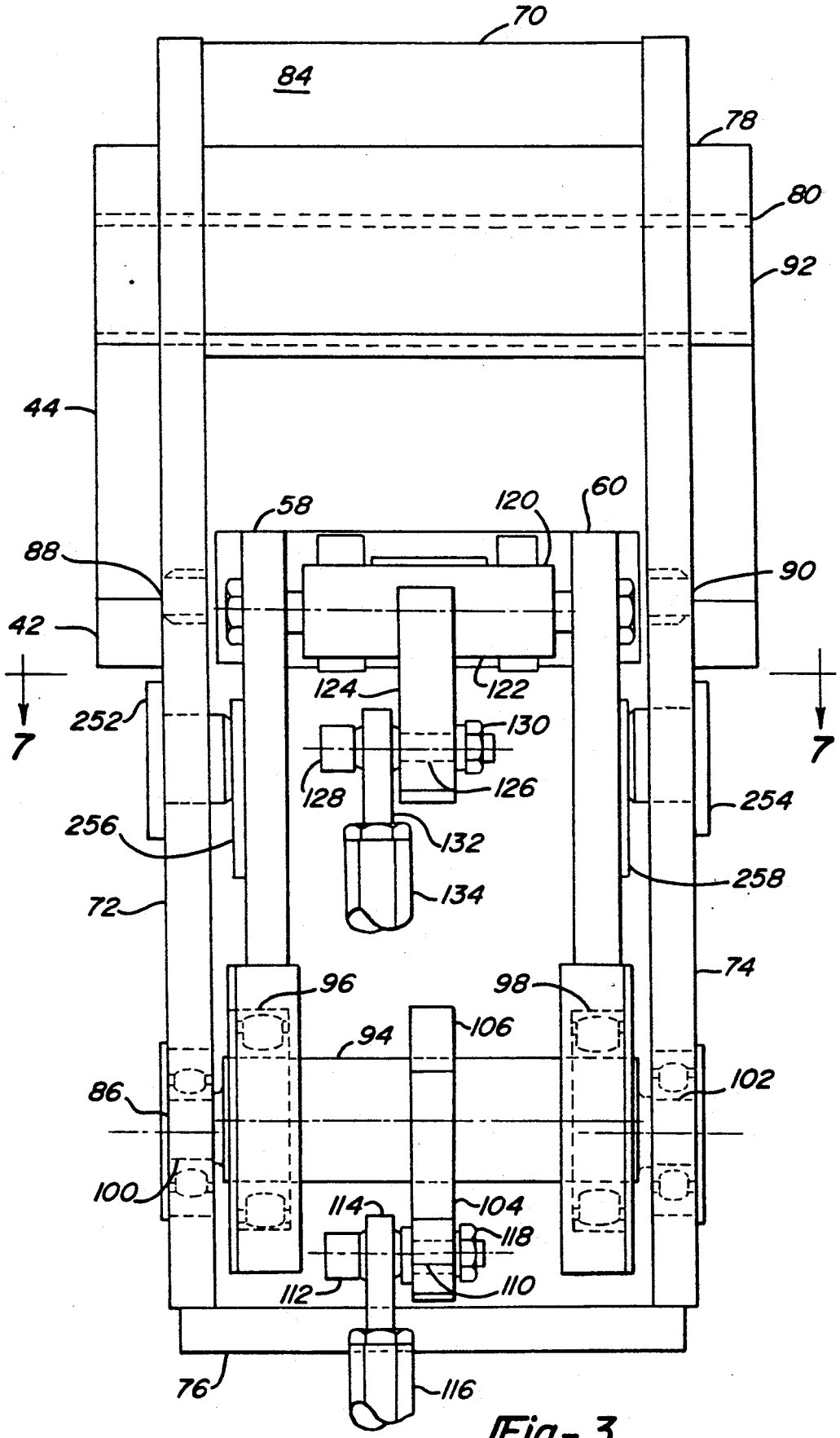
FIG. 3 is an elevational end view of the apparatus as shown in FIGS. 1 and 2.

FIG. 3 is an elevational end view of the overall apparatus 16 as shown in FIGS. 1 and 2. The elongate plates 72 and 74 of the hemmer bracket 70 are shown as they extend from the cross bar 76 of the bottom of FIG. 3 to the cross plate 84 at the top. The upwardly extending arms 58 and 60 of the cantilevered bracket 46 are shown positioned inboard of the elongate plates 72 and 74. The hemming steel 92 not only spans the distance between the elongate plates 72 and 74, but, also, extends beyond them in a horizontal direction. The lower portion of the hemmer bracket 70 is supported by the horizontally aligned eccentric shaft 86 that has an enlarged central span 94. Each end of the enlarged central span 94 of the eccentric shaft 86 is journaled in the cantilevered bracket 46 with a set of bearings 96 and 98. The ends 100 and 102 of the eccentric shaft 86 are of reduced diameter and have a common axis that is offset from the axis of the central span 94. A lower crank arm 104 is clamped at the midpoint of the enlarged central span 94 of the eccentric shaft 86. The lower crank arm 104 has a diametrical split at its enlarged end that permits clamping to the eccentric shaft 86. The clamping of the lower crank arm 104 is facilitated by a keeper 106 and a pair of clamp bolts 108. The keeper 106 and the bolts 108 can best be seen in FIG. 2. The cantilevered end of the lower crank arm 104 contains a bore 110 through which a shouldered bolt 112 is installed. A spherical male rod end 114 is held in position by the bolt 112. The male rod end 114 is attached to a push-pull rod 116. The shouldered bolt 112 is retained in the bore 110 by a nut 118.

A crank arm assembly 120 is mounted in a horizontal attitude between the upwardly extending arms 58 and 60 of the cantilevered bracket 46. The crank arm assembly 120 has a central shaft 122 of enlarged diameter. The central shaft 122 is rotatably mounted in the upwardly extending arms 58 and 60 of the cantilevered bracket 46 by a journaling system more fully explained later herein. The crank arm assembly 120 has a cantilevered upper crank arm 124 that is attached to the central shaft 122. The upper crank arm 124 is positioned centrally along the central shaft 122 and is attached thereto preferably by welding. The end of the upper crank arm 124 has a bore 126 through the free end. A shouldered bolt 128 is positioned through the bore 126 and is immobilized by a nut 130. The shouldered portion of the bolt 128 captivates a spherical male rod end 132 which in turn is attached to the end of a push-pull rod 134.

Figure 4:
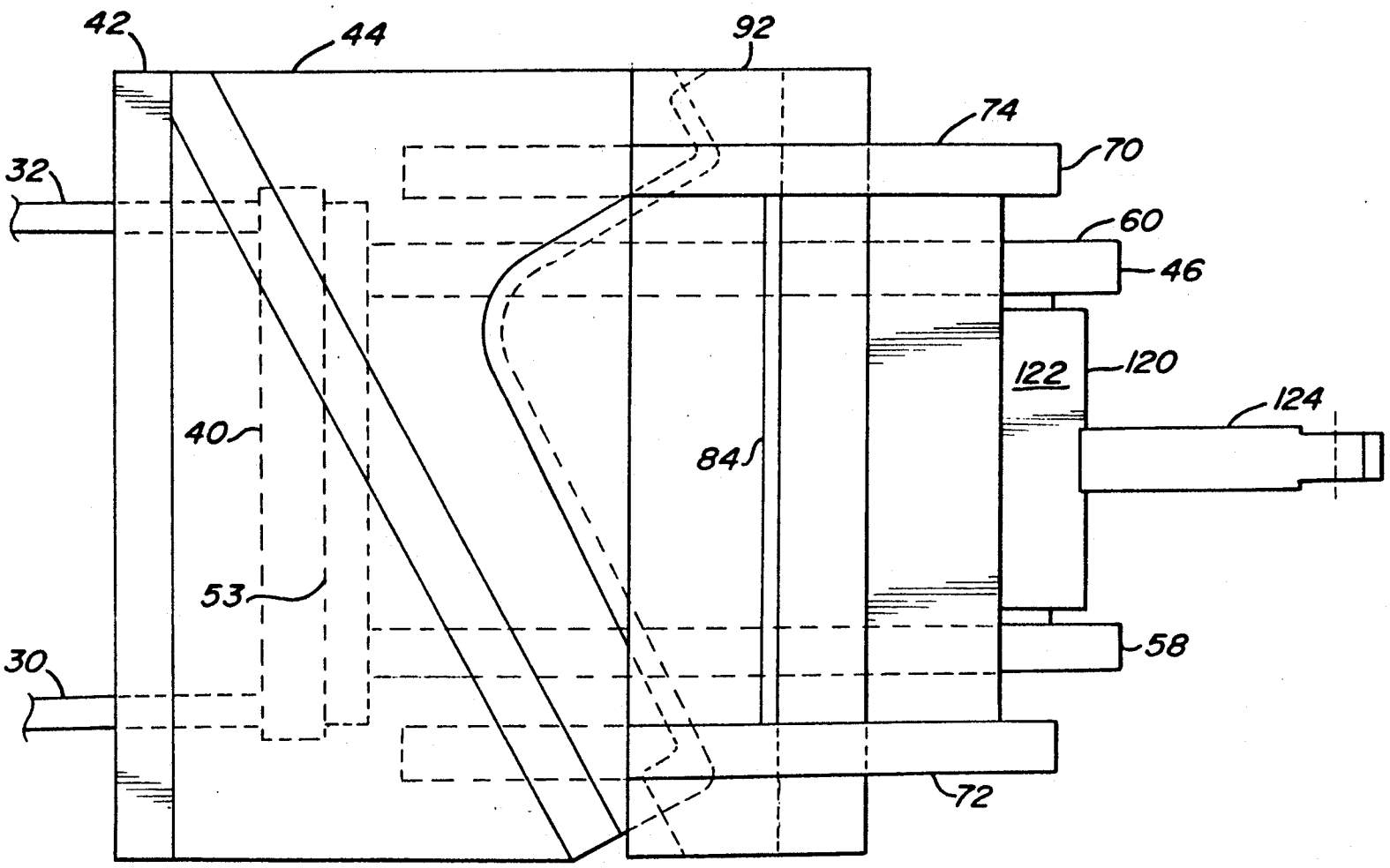
FIG. 4 is a plan view of the apparatus which shows the anvil and part of its support structure along with the hemming steel and the hemming bracket.

FIG. 4 is a plan view of the overall apparatus 16 which shows the top of the anvil 44 and part of its support structure along with the hemming steel 92, the cantilevered bracket 46, and the hemmer bracket 70. The contour of the surface of the anvil 44 and the companion hemming steel 92 is not of linear configuration as can be seen in FIG. 4. The width of the overall apparatus 16 is defined by the anvil 44 and the hemming steel 92, therefore, a similar apparatus can be placed adjacent thereto to operate in unison under the influence of a common power source.

Figure 5:
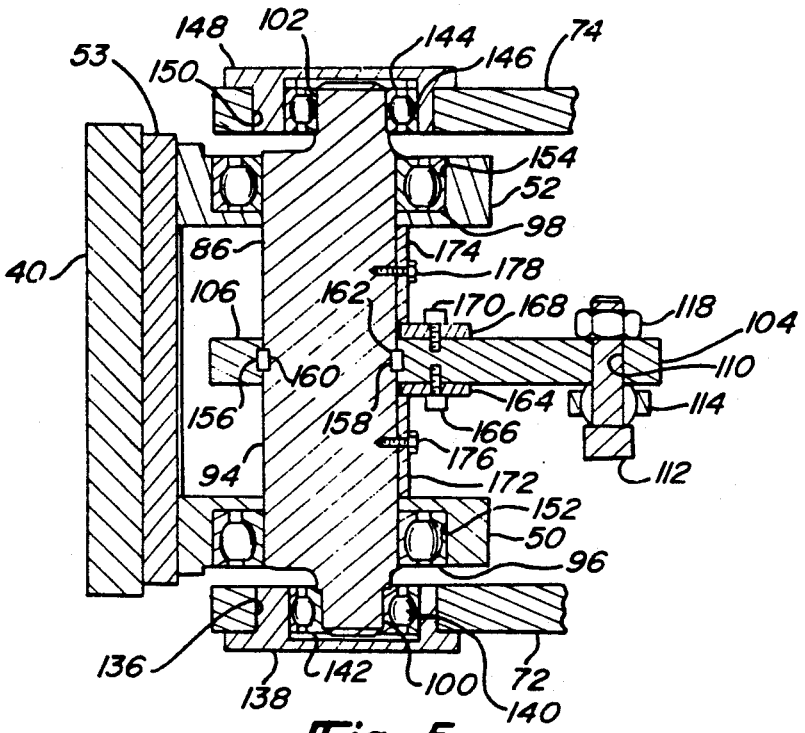
FIG. 5 is a cross-sectional view taken along lines 5—5 of FIG. 2 which shows the lower crank arm and the eccentrically journaled shaft to which it is attached.

FIG. 5 is a cross-sectioned view taken along lines 5—5 of FIG. 2 which shows the lower crank arm 104 and the eccentrically aligned journaled eccentric shaft 86 to which it is attached. The top front plate 40 of the columnar bracket 24 is shown at the left side of FIG. 5. The back plate 53 of the cantilevered bracket 46 is attached to the top front plate 40 by the bolts 48, as shown in FIG. 1. The vertical side plates 50 and 52 of the cantilevered bracket 46 are preferably attached to the back plate 53 by welding. A bore 136 is positioned in the elongate plate 72. An eccentric cartridge 138 is positioned in the bore 136. The eccentric cartridge 138 includes a bore 140 into which the reduced diameter end 100 of the eccentric shaft 86 is journaled by a bearing 142. In a similar manner, the other end 102 of the eccentric shaft 86 is journaled in a bearing 144 that is retained in a bore 146 within an eccentric cartridge 148, which in turn is positioned in a bore 150 in the elongate plate 74. Thus, the lower end of the hemmer bracket 70 can move with respect to the immobile cantilevered bracket 46. The central span 94 of the eccentric shaft 86 has a greater diametrical extent than does the reduced diameter ends 100 and 102. The ends of the central span 94 are journaled within the bearings 96 and 98. The bearing 96 is positioned in a bore 152 in the vertical side plate 50; likewise, the bearing 98 is positioned in a bore 154 in the vertical side plate 52. Returning once again to the lower crank arm 104, which is positioned at the center of the eccentric shaft 86, a pair of keys 156 and 158 are utilized to prevent rotational movement of the lower crank arm 104 with respect to the eccentric shaft 86. The key 156 is positioned in a groove 160 within the eccentric shaft 86 and a complementary groove in the keeper 106. The key 158 is positioned in a groove 162 within the eccentric shaft 86 diametrically opposite the key 156. The key 156 is held in a complementary groove within the lower crank arm 104. The keys 156 and 158 are held in position when the bolts 108 (see FIG. 2) are installed in the keeper 106 and the lower crank arm 104.

In order to provide lateral stylization and adjustment, a washer 164 is positioned on one side of the lower crank arm 104 adjacent to the central span of the eccentric shaft 86.

Another washer 168 is positioned in juxtaposed relationship on the other side of the lower crank arm 104. The washers 164 and 168 are anchored by a pair of bolts 166 and 170, respectively. In conjunction with the washer 164, a retainer 172 is positioned between the washer 164 and the inner surface of the vertical side plate 50. The retainer 172 is longitudinally in alignment with the axis of the eccentric shaft 86. An additional retainer 174 is positioned between the inner surface of the vertical side plate 52 and the washer 168. The retainers 172 and 174 are held in position with bolts 176 and 178.

Figure 6:
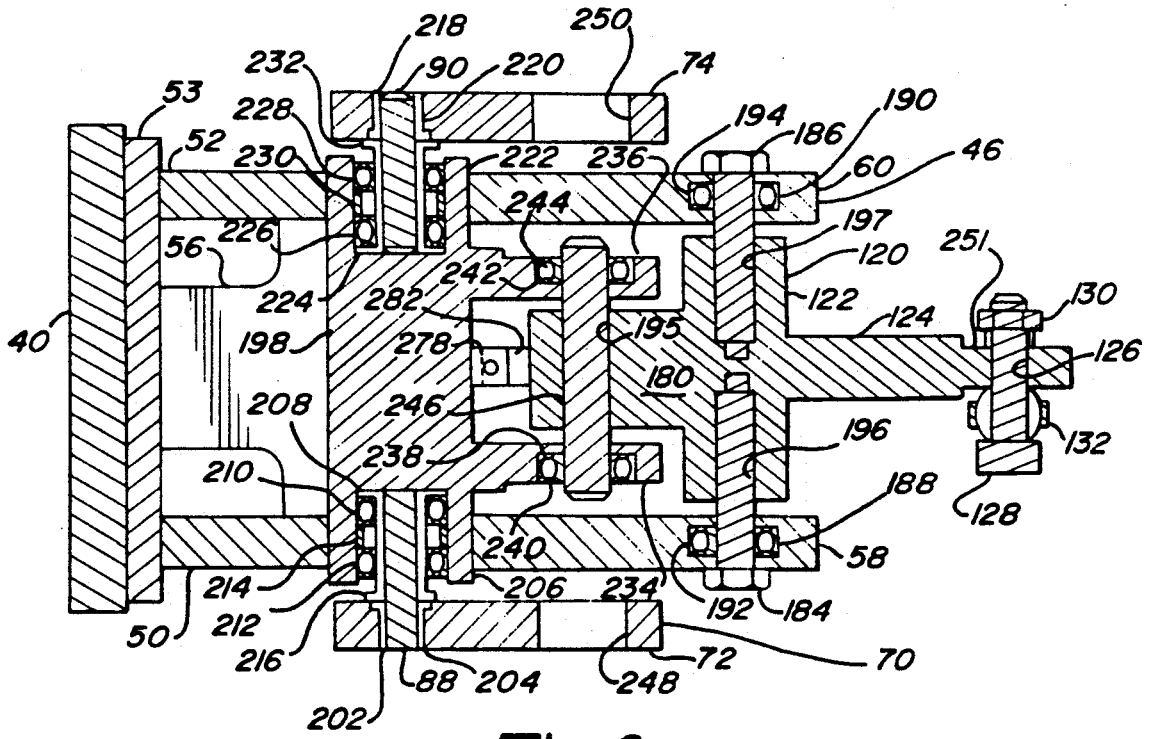
FIG. 6 is a cross-sectional view taken along lines 6—6 of FIG. 2 which shows the upper crank arm and the linkage between the support frame and the hemmer bracket.

FIG. 6 is a cross-sectional view taken along lines 6—6 of FIG. 2 which shows the upper crank arm 124 and the linkage between the cantilevered bracket 46 and the hemmer bracket 70. The top front plate 40 of the columnar bracket 24 is shown at the left of FIG. 6. The back plate 53 of the cantilevered bracket 46 is shown adjacent to the top front plate 40. The top plate 56 is also shown as it spans the distance between the base of the upwardly extending arms 58 and 60. The crank arm assembly 120 of which the upper crank arm 124 is a component is shown as it is mounted between the upwardly extending arms 58 and 60. The crank arm assembly 120 has a block 180 which is in opposed relationship with respect to the upper crank arm 124. The block 180 and the upper crank arm 124 are preferably attached to the central shaft 122 by welding. The crank arm assembly 120 is supported by a pair of bolts 184 and 186 which are journaled in a pair of bearings 188 and 190. The bearing 188 is positioned in a bore 192 in the upwardly extending arm 58 and the bearing 190 is similarly positioned in a bore 194 in the upwardly extending arm 60. The bolts 184 and 186 pass through respective transverse bores 196 and 197 in the ends of the central shaft 122. A reduced diameter threaded section on the ends of the bolts 184 and 186 retains them in the crank arm assembly 120. The block 180 of the crank arm assembly 120 contains a transverse bore 195 that is parallel to the axis of the central shaft 122.

A drag link 198 is supported by the support shafts 88 and 90. The outer end of the support shaft 88 is journaled within a bushing 202 that is positioned within a bore 204 in the elongate plate 72. The drag link 198 has a shaft end 206 that contains a bore 208 in which a pair of spaced apart bearings 210 and 212 are separated with a spacer tube 214. The pair of spaced apart bearings 210 and 212 contain an elongate apertured bushing 216. The support shaft 88 is partially contained within the apertured bushing 218 that is positioned within a bore 220 in the elongate plate 74. The drag link 198 has a shaft end 222 opposite the shaft end 206. The shaft end 222 contains a bore 224 that contains a pair of spaced apart bearings 226 and 228 that are separated by a spacer tube 230. An elongate apertured bushing 232 is positioned within the bearings 226 and 228. The support shaft 90 is journaled within the apertured bushing 232 and in the bushing 218 that is contained in the elongate plate 74.

The drag link 198 contains a pair of integrally fixed legs 234 and 236. The leg 234 contains a bore 238 into which a bearing 240 is inserted. Likewise, the leg 236 contains a bore 242 for a bearing 244. A removable pin 246 is trained through the transverse bore 195 in the block 180 and also through the bearings 240 and 244. The removable pin 246 is maintained in position by cotter pins (not shown). An aperture 248 is placed in the elongate plate 72 and a similar aperture 250 is placed in the elongate plate 74. The apertures 248 and 250 facilitate rapid disassembly of the removable pin 246. The upper crank arm 124 which is an integral part of the crank arm assembly 120 contains a reduced thickness section 251 at the end thereof in the vicinity of the bore 126.

Figure 7:
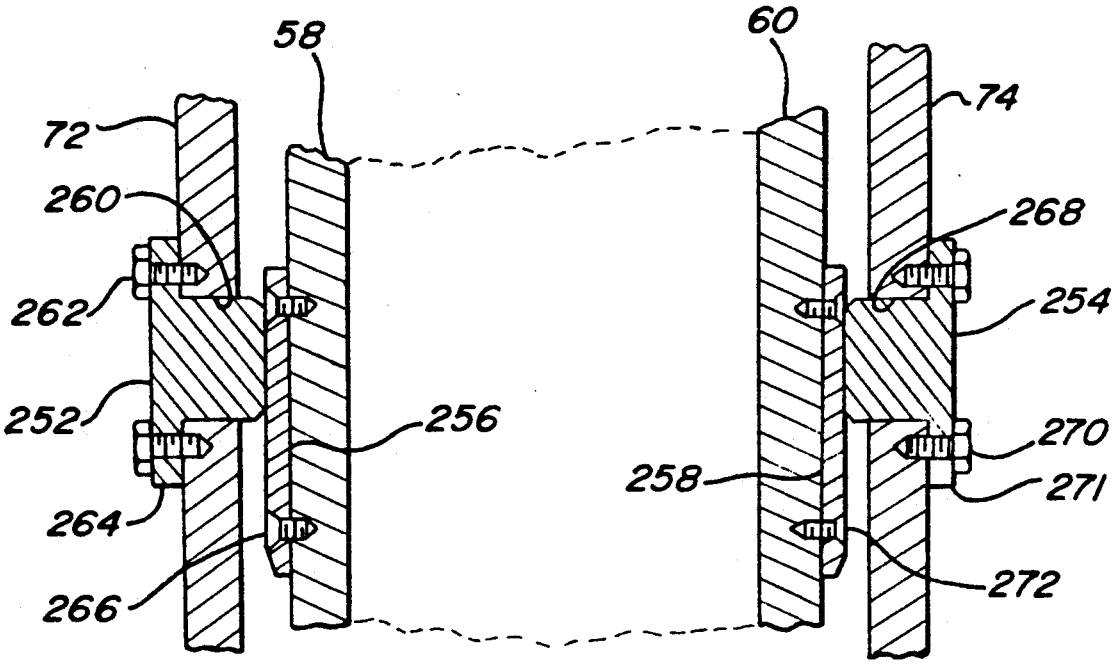
FIG. 7 is a fragmentary cross-sectional view taken along lines 7—7 of FIG. 3 that shows the interaction between the guide shoes and their respective wear plates.

FIG. 7 is a fragmentary cross-sectional view taken along lines 7—7 of FIG. 3 that shows the interaction between a pair of guide shoes 252 and 254 and their respective wear plates 256 and 258. The guide shoe 252 is contained within a bore 260 that is located near the midsection of the elongate plate 72. The guide shoe 252 is held in position by bolts 262 which pass through a flanged area 264 on the guide shoe 252 and into threaded engagement with the elongate plate 72. The wear plate 256, which is preferably made of bronze, is attached to the upwardly extending arm 58 of the cantilevered bracket 46 by recessed bolts 266. The guide shoe 254 is positioned within a bore 268 that is positioned through the elongate plate 74. The guide shoe 254 is captivated by a series of bolts 270 that pass through a flanged area 271 of the guide shoe 254 and into the elongate plate 74. The wear plate 258 is similar in material and configuration to the wear plate 256 and is held in place by a plurality of recessed bolts 272. The leading edges of the wear plates 256 and 258 are beveled to facilitate the movement of the guide shoes 252 and 254 thereover. The guide shoes 252 and 254 control the lateral movement of the hemmer bracket 70 as it moves under the influence of the lower and upper crank arms 104 and 124.

Figure 8:
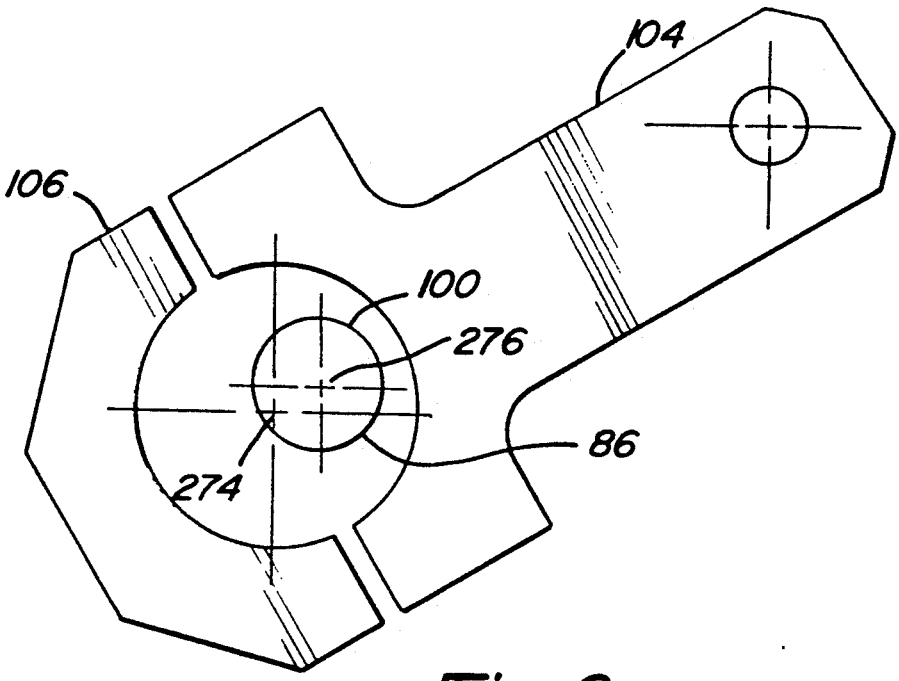
FIG. 8 is a schematic side view of the lower crank arm when rotated to its uppermost position.

FIG. 8 is a schematic side view of the lower crank arm 104 when it is rotated to its uppermost position. When in the position shown in FIG. 8, the lower crank arm 104 is inclined at an angle of approximately thirty degrees with respect to the horizontal. The lower crank arm 104 has a center of rotation that is coincident with the longitudinal axis of the central span 94 of the eccentric shaft 86 which rotates but does not undergo a translation (see FIG. 5). Thus, the center of rotation of the lower crank arm 104 is represented by the numeral 274. The center of the axis that passes through the reduced diameter ends 100 and 102 is identified by the numeral 276. As the lower crank arm 104 rotates about the fixed center of rotation 274, the center 276 of the reduced diameter end 100 moves in an arcuate path. Since the reduced diameter ends 100 and 102 are journaled in the hemmer bracket 70, the lower portion of the hemmer bracket 70 also moves in an arcuate path. The net effect of such arcuate movement causes the entire hemmer bracket 70 to be lifted primarily in a vertical direction with a minimum of horizontal displacement.

Figure 9:
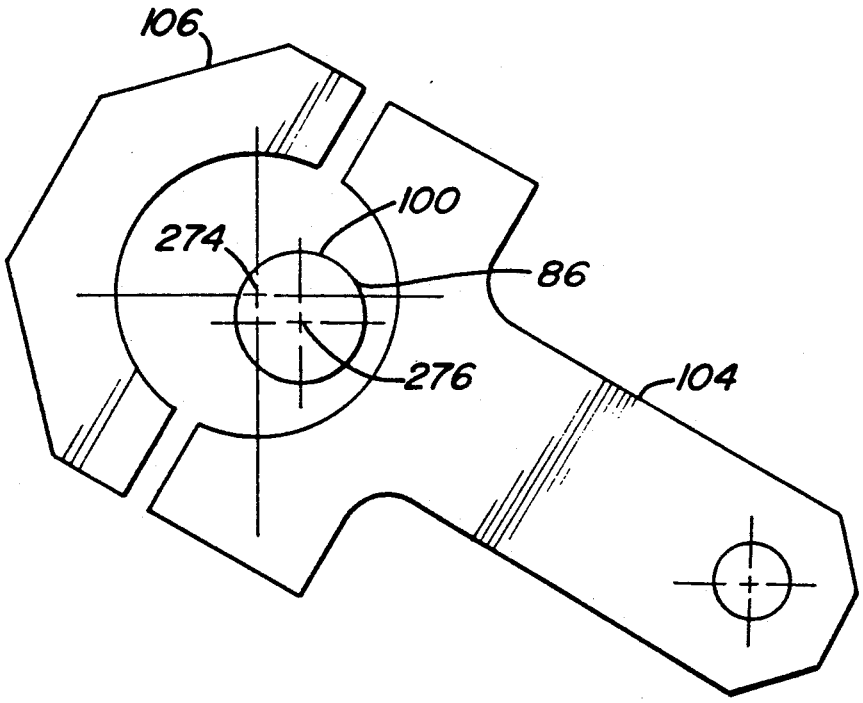
FIG. 9 is a view similar to FIG. 8 except that the lower crank arm is in its lowermost position.

FIG. 9 is a schematic side view similar to FIG. 8 except that the lower crank arm 104 is in its lowermost position. The lower crank arm 104 is shown in a position that is approximately thirty degrees below the horizontal. In this position, the center 276 has moved arcuately down from its previous uppermost position. With the center 276 in its lowermost position, the entire hemmer bracket 70 is lowered. Thus, the up and down motion of the hemmer bracket 70 can be very accurately controlled. Since the lower crank arm 104 has a push-pull rod 116 (see FIGS. 1 through 3) that is independent of all other controls, the hemmer bracket 70 can be raised or lowered at any time during the hemming cycle.

Figure 10:
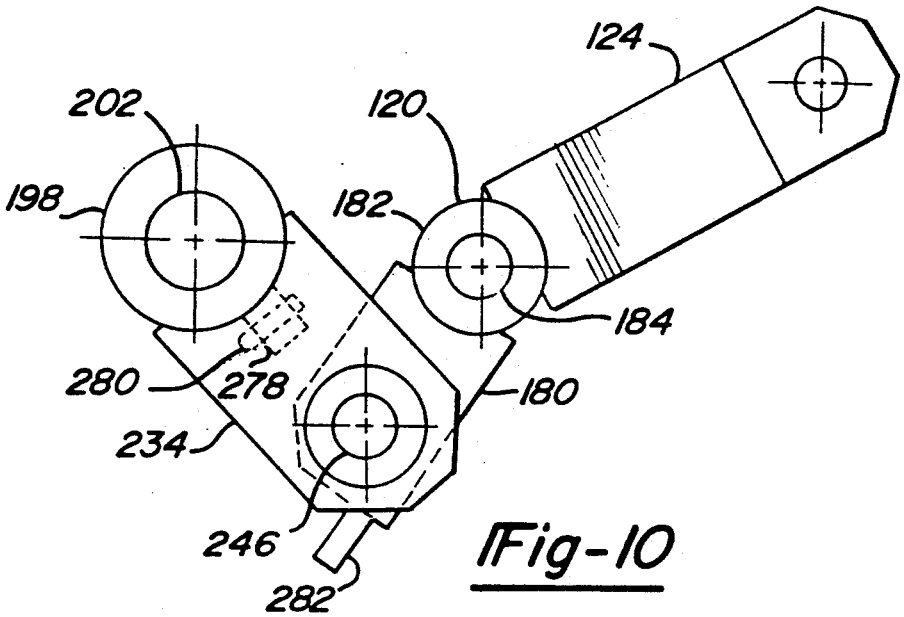
FIG. 10 is a schematic outline of the upper crank arm when rotated to its uppermost position.

FIG. 10 is a schematic outline of the upper crank arm 124 when it is rotated to its uppermost position. When the upper crank arm 124 is in the position shown in FIG. 10, it makes an angle approximately thirty degrees with respect to a horizontal plane. Since the upper crank arm 124 and the block 180 are both attached to the crank arm assembly 120, the block 180 and the removable pin 246 have rotated to a lowermost position. The lower position of the removable pin 246 causes the legs 234 and 236 of the drag link 198 to assume a position of greatest angle with respect to the horizontal. Consequently, the drag link 198 has moved to the right. The drag link 198 moves to the right when the upper crank arm 124 is in an up position because the drag link 198 is journaled in the hemmer bracket 70 which rotates about the center 276 (see FIG. 2).

Also shown in FIG. 10 is an adjustment and set up stop mechanism. A cantilevered tab 278 is rigidly attached to a central section of the drag link 198. An adjustment screw 280 is positioned within a threaded bore in the cantilevered tab 278. A similar cantilevered tab 282 is rigidly attached to the end of the block 180. The attitude of the crank arm assembly 120 and the drag link 198, as viewed in FIG. 10, causes the cantilevered tabs 278 and 282 to be a considerable distance from one another.

Figure 11:
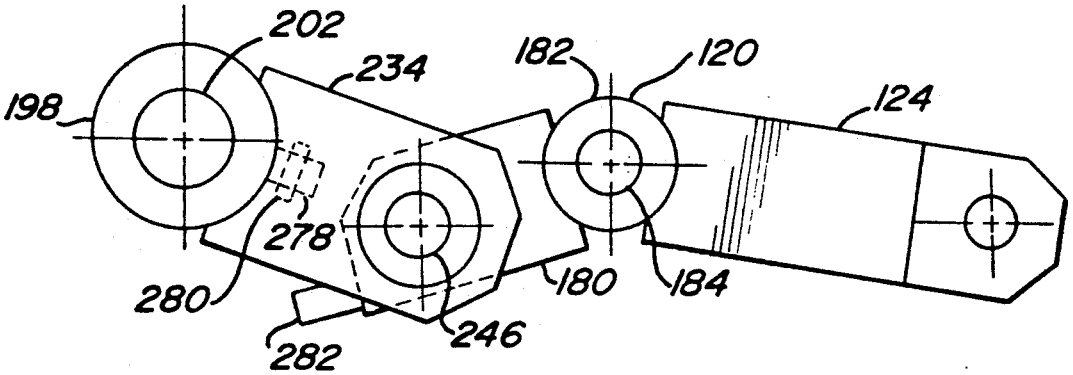
FIG. 11 is a view similar to FIG. 10 wherein the upper crank arm is in an intermediate rotated position.

FIG. 11 is a view similar to that shown in FIG. 10 wherein the upper crank arm 124 has rotated to an intermediate position. In the attitude shown in FIG. 11, the upper crank arm 124 has assumed a rotational position that is approximately ten degrees below the horizontal plane. Of course, the entire crank arm assembly rotates, consequently, the block 180 has rotated to a more horizontal position. As the block 180 rotates toward a horizontal attitude, the removable pin 246 moves toward the left, causing the drag link 198 to also move toward the left. The movement of the drag link 198 to the left causes the hemmer bracket 70 to rotate counterclockwise about the center 276 (see FIG. 2). The cantilevered tabs 278 and 282 have approached each other but have not made contact with each other as can be seen in FIG. 11.

Figure 12:
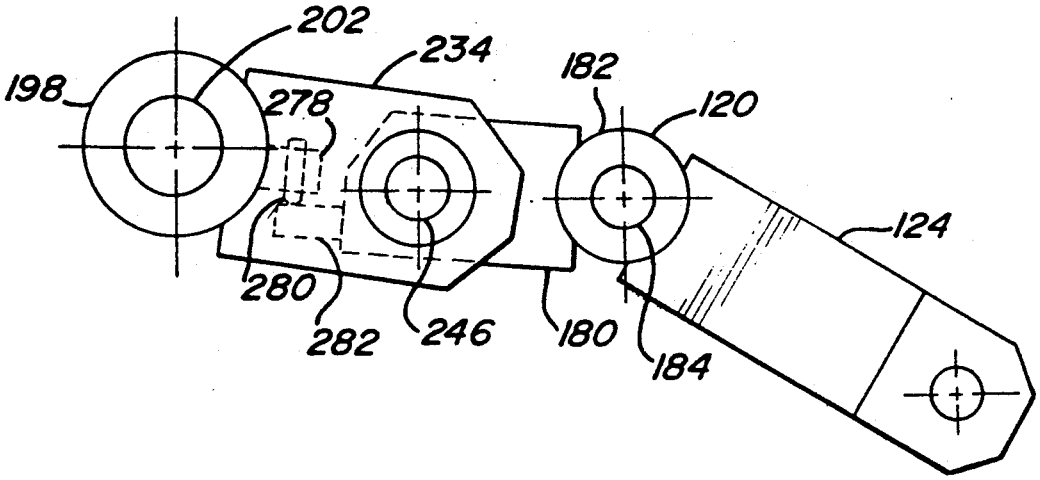
FIG. 12 is an additional view similar to FIG. 10 wherein the upper crank arm is rotated to its lowermost position.

FIG. 12 is an additional view similar to FIG. 10 wherein the upper crank arm 124 has assumed its lowermost position. The upper crank arm 124 has assumed a position that is approximately thirty degrees below the horizontal plane. The clockwise rotation of the crank arm assembly 120 has caused the block 180 to assume an axial position slightly above the horizontal plane. In this position, the block 180 has carried the removable pin 246 to its left most position. The drag link 198 also moves to the left, causing additional counterclockwise rotation of the hemmer bracket 70 about the center 276. In the position shown in FIG. 12, the cantilevered tabs 278 and 282 have moved toward each other until the adjustment screw 280 has made contact with the top surface of the cantilevered tab 282. The adjustment screw 280 permits small angular adjustments to be made during initial set up of the overall apparatus 16 and the adjustment of the push-pull rod 134.

ASSEMBLY AND OPERATION

The assembly of the overall apparatus 16 of the present invention is uncomplicated because of the simplicity of the design. The base plate 22 and the support column 20 along with the base pad 18 can be welded together if desired. The columnar bracket 24 is then bolted to the base plate 22 with the bolts 28 and the cantilevered bracket 46 is then bolted to the columnar bracket 24 with the bolts 48. The eccentric shaft 86 and accompanying bearings 96 and 98 are installed in the cantilevered bracket 46. The lower crank arm 104 and its adjustment mechanism is installed on the eccentric shaft 86. The wear plates 256 and 258 are attached to the outer surfaces of the cantilevered bracket 46 with the recessed bolts 266 and 272. The hemmer bracket 70 is coupled to the reduced diameter ends 100 and 102 by installation of the eccentric cartridges 138 and 148 after the guide shoes 252 and 254 have been installed. The drag link 198 is equipped with its multiple sets of internal bearings 210 and 212, 226 and 228 suspended across the hemmer bracket 70 by the support shafts 88 and 90 and accompanying bushings 202, 216, 218 and 232. The crank arm assembly 120 is then installed with the aid of the bearings 188 and 190 and the bolts 184 and 186. The anvil 44 is then installed to the anvil support plate 42 with bolts (not shown). The hemming steel 92 is anchored to the L-shaped cross member 78 by bolts (not shown). The spacers 80 and 82 are sized and installed with the hemming steel 92. The removable pin 246 is installed, thus coupling the drag link 198 to the crank arm assembly 120. The push-pull rods 116 and 134 and their associated hardware are adjusted to the proper length and coupled to the upper and lower crank arms 124 and 104.

Figure 13:
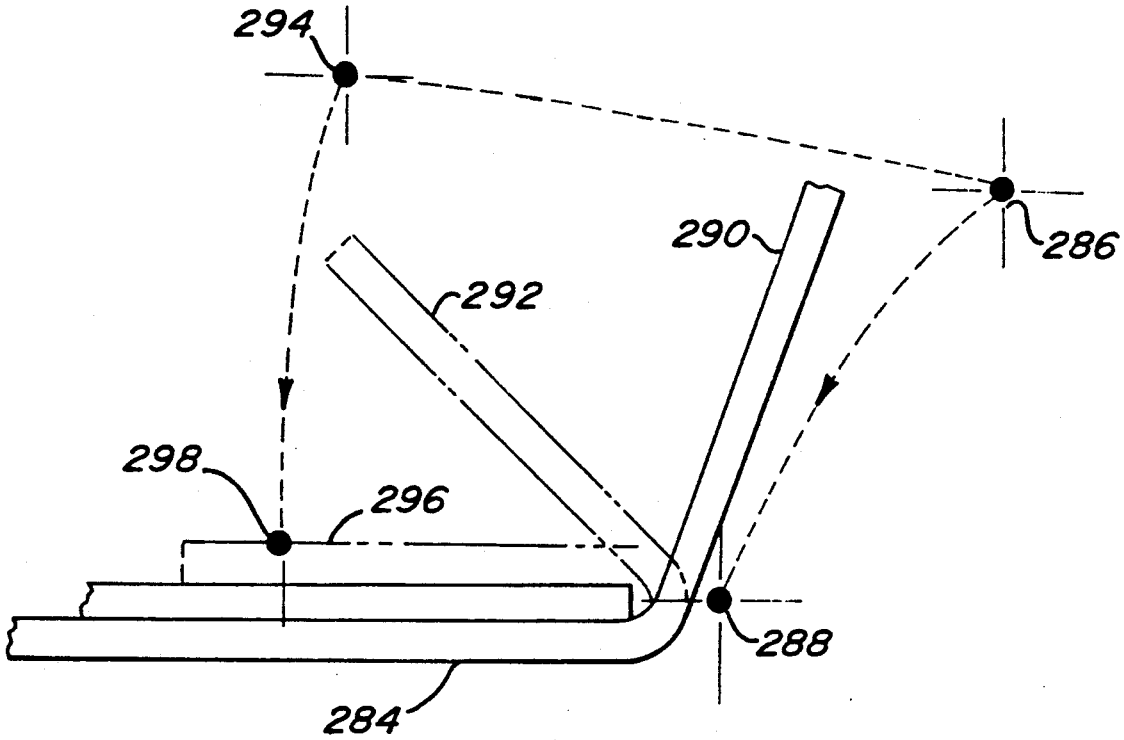
FIG. 13 is an enlarged schematic view of the circle 13—13 of FIG. 2 which shows the workpiece and the path of travel of the hemming steel.

FIG. 13 is an enlarged schematic view of the circle 13—13 of FIG. 2 which shows a workpiece 284 and the path of travel of the hemming steel 92. At the initial start position, the hemming steel 92 is at a location remote from the anvil 44. The start point is designated by the numeral 286 which is shown at the right side of FIG. 13. The initial start position is also the load position when the workpiece 284 is positioned on the anvil 44 of the overall apparatus 16 and adjacently positioned similar hemming apparatus. In order for the hemming steel 92 to assume the load position, that is, the point 286, the upper crank arm 124 is at the top of its rotation which will be designated as up sixty degrees. This position is depicted in FIG. 10. At the load or start position, the lower crank arm 104 is at the up sixty degrees position, as shown in FIG. 8. The upper and lower crank arms 124 and 104 begin a slow clockwise rotation under the influence of their respective push-pull rods 134 and 116. The upper crank arm 124 stops at a down forty degrees position whereas the lower crank arm 104 rotates to a down sixty degrees or bottom location. At this time the hemming steel 92 has moved to a point 288 just to the left of the edge of the workpiece 284. During the travel of the hemming steel 92 from the point 286 to the point 288, the outstanding flange 290 of the workpiece 284 is moved to the location 292. The upper crank arm 124 is then moved up forty degrees and simultaneously the lower crank arm 104 is moved up sixty degrees. Thus, the hemming steel 92 returns to the point 286. The upper crank arm 124 then moves to a down sixty degrees position thus moving the hemming steel 92 to the point 294. The lower crank arm 104 is then moved to the sixty degrees down position thus moving the outstanding flange 290 to the location 296. At this time, the hemming steel 92 is at the point 298. The lower crank arm 104 is then moved to the up sixty degrees position causing the hemming steel 92 to leave the point 298 and return to the point 294. The upper crank arm 124 is then moved to the up sixty degrees position, causing the hemming steel 92 to return to the point 286 which is the initial loading point.

Since the upper and lower crank arms 124 and 104 are independent of one another, their movement can be programmed to vary the movement of the hemming steel 92 according to the demands of the particular workpiece.

The present invention also encompasses a method of hemming a multipart workpiece wherein a portion of the workpiece 284 is folded over upon itself as depicted in FIG. 13. In the prior art methods of hemming, the initial bend is made by a downward motion of the hemming steel. The downward motion of the hemming steel is then followed by a sliding forward motion with the hemming steel, in essence, ironing the bent outstanding flange 290 to its final position. In the present invention, the hemming steel 92 makes contact with the outstanding flange 290 of the workpiece 284 and bends it to a partially closed position. The hemming steel 92 is then moved away from the partially closed outstanding flange 290 to the point 286. The hemming steel 92 then moves forward over the partially closed outstanding flange 290 without actually making contact therewith. The hemming steel then moves from the point 294 toward the workpiece 284, causing the outstanding flange 290 to be folded against the remainder of the workpiece 284. The hemming steel 92 arrives at the point 298 when the outstanding flange 290 is completely folded. The hemming steel 92 is not dragged across the surface of the workpiece 284 as it is removed. Instead, the hemming steel 92 is lifted to a position where it no longer contacts the workpiece 284 before the hemming steel 92 is moved to a location remote from the workpiece 284. Of course, it is evident to those skilled in the art that the exact sequential horizontal and vertical movement of the hemming steel 92 can be varied.

While the illustrative emboidment of the invention has been described in considerable detail for the purpose of setting forth practical operative structures whereby the invention may be practiced, it is to be understood that the particular apparatus described is intended to be illustrative only, and that the various novel characteristics of the invention may be incorporated in other structural forms and method steps without departing from the spirit and scope of the invention defined in the appended claims.

What is claimed is:

1. An apparatus for hemming an upstanding peripheral flange of an outer panel member to overlie the periphery of an inner panel member which is nested with said outer panel member to thereby join said outer panel member to said inner panel member, said apparatus comprising:

a base member;

means for supporting and holding said outer panel member and said inner panel member in spaced relationship to each other, said supporting and holding means being mounted to said base member;

a cantilevered bracket attached to said supporting and holding means, said cantilevered bracket having one end wall attached to said supporting and holding means and at least one arm extending in a direction away from said one end wall, said at least one arm having a first pivot axis therein spaced a predetermined distance from said suppporting and holding means, said cantilevered bracket further having at least one side wall complementary with said one end wall and extending in a direction away from said one end wall, said at least one side wall having a second pivot axis therein, said cantilevered bracket being mounted to said supporting and holding means so that said one end wall, at least one arm, and at least one side wall are all fixed relative to said supporting and holding means;

a hemmer bracket positioned adjacent said cantilevered bracket, said hemmer bracket having a first pivot axis substantially parallel to and spaced a predetermined distance from said first pivot axis of said at least one arm of said cantilevered bracket and a second pivot axis parallel to and offset a predetermined radial distance from said second pivot axis of said at least one side wall;

a hemming steel attached to said hemmer bracket, said hemming steel facing said supporting and holding means in spaced apart juxtaposed relationship;

pivotable crank arm link means interposed said hemmer bracket and said at least one arm extending in a direction away from said one end wall, said pivotable crank arm link means having a third pivot axis at one end thereof coincident with said first pivot axis of said hemmer bracket such that said one end of said pivotable crank arm link means pivots about said first pivot axis of said hemmer bracket, said pivotable crank arm link means further having a fourth pivot axis located intermediate said one end and an opposite end, said fourth pivot axis being coincident with said first pivot axis of said least one arm of said cantilevered bracket such that rotation of said pivotable crank arm link means about said first pivot axis of said hemmer bracket and said first pivot axis of said at least one arm urges said hemmer bracket to translate pivotably along a first substantially arcuate path about said second pivot axis of said hemmer bracket in a direction towards said upstanding peripheral flange to perform a first stage hemming of said upstanding peripheral flange whereby said upstanding peripheral flange is folded over from a substantially upright position to a position approximately midway between said upstanding position and a final hemming position;

oscillatable eccentric link means interposed said hemmer bracket and said at least one side wall of said cantilevered bracket, said oscillatable eccentric link means having a fifth pivot axis at one end thereof coincident with said second pivot axis of said at least one side wall, whereby said oscillatable eccentric link means translates pivotably about said second pivot axis of said at least one side wall of said cantilevered bracket;

said hemmer bracket being mounted to said oscillatable eccentric link means about said second pivot axis of said hemmer bracket such that oscillatory movement of said oscillatable eccentric link means moves said hemmer bracket in an arcuate motion about said second pivot axis of said at least one side wall; and means for moving said pivotable crank arm link means and said oscillatable eccentric link means whereby concurrent rotary movement of said oscillatable eccentric link means and said pivotable crank arm link means moves said hemming steel attached to said hemmer bracket to a position above said approximately midway position of said peripheral upstanding flange such that a subsequent rotary movement of said oscillatable eccentric link means moves said hemming steel attached to said hemmer bracket in a downward motion to said final stage hemming position whereby said peripheral upstanding flange overlies said inner panel member to hem said inner and outer panel members.

2. The apparatus of claim 1 wherein said means for supporting and holding further comprises:

spaced apart side plates coupled to a rear plate and at least one front plate;

a horizontally disposed plate attached to said spaced apart side plates; and anvil means attached to said horizontally disposed plate for supporting said outer panel member and inner panel member in spaced relationship to each other.

3. The apparatus of claim 2 wherein said means for supporting and holding is a weldment.

4. The apparatus of claim 2 wherein said at least one arm extending in a direction away from said one end wall of said cantilevered bracket is attached to said spaced apart side plates.

5. The apparatus of claim 1 wherein said hemmer bracket is oriented in a generally vertical attitude.

6. The apparatus of claim 1 further comprising an L-shaped spacer backup member attached to said hemming steel such that said hemming steel is strengthened by being coupled to said L-shaped spacer backup member.

7. The apparatus of claim 1 wherein said oscillatable eccentric link means further comprises:

a first shaft mounted about said fifth axis of said oscillatable eccentric link means coincident with said second pivot axis of said at least one side wall;

a lower crank arm link attached to said first shaft for rotation therewith; and eccentric shaft means mounted to said first shaft for rotating movement therewith, said hemmer bracket being mounted to said eccentric shaft means;

whereby said means for moving said pivotable crank arm link means and said oscillatable eccentric link means moves said lower crank arm link in an oscillatory movement such that as said lower crank arm link oscillates said eccentric shaft means moves said hemmer bracket in an arcuate movement to lift said hemmer bracket in primarily a vertical direction with a minimum predetermined horizontal displacement.

8. The apparatus of claim 7 wherein said eccentric shaft means rotates about said second pivot axis fixed against translation with respect to said at least one side wall of said cantilevered bracket.

9. The apparatus of claim 2 wherein said overall apparatus has an overall width that does not exceed the width of said anvil means.

10. The apparatus of claim 7 wherein said means for moving said pivotable crank arm link means and said oscillatable eccentric link means comprises a first push-pull rod.

11. The apparatus of claim 10 wherein said means for moving said pivotable crank arm link means and said oscillatable eccentric link means comprises a second push-pull rod.

12. The apparatus of claim 1 wherein said pivotable crank arm link means further comprises:

a central shaft journaled to said at least one arm of said cantilevered bracket about said first pivot axis of said at least one arm;

a block member attached to said central shaft and extending towards said first pivot axis of said hemmer bracket;

a drag link member journaled about said first pivot axis of said hemmer bracket and extending towards said block member;

means for attaching said drag link member to said block member;

an upper crank arm mounted to said central shaft in a direction away from said block member; and means for moving said upper crank arm in a pivotable movement, said moving means being attached to said upper crank arm such that said upper crank arm pivots said hemmer bracket in a direction towards and away from said supporting and holding means about said second pivot axis of said hemmer bracket to move said hemming steel over said midway position of said upstanding peripheral flange.

13. The apparatus of claim 11 wherein said pivotable crank arm link means further comprises:

a central shaft journaled to said at least one arm of said cantilevered bracket about said first pivot axis of said at least one arm;

a block member attached to said central shaft and extending towards said first pivot axis of said hemmer bracket;

a drag link member journaled about said first pivot axis of said hemmer bracket and extending towards said block member;

means for attaching said drag link member to said block member;

an upper crank arm mounted to said central shaft in a direction away from said block member; and means for moving said upper crank arm in a pivotable movement, said moving means being attached to said upper crank arm such that said upper crank arm pivots said hemmer bracket in a direction towards and away from said supporting and holding means about said second pivot axis of said hemmer bracket to move said hemming steel over said approximately midway position of said upstanding peripheral flange.

14. The apparatus of claim 13 wherein said plurality of push-pull rods are independently driven.

15. An apparatus for hemming an upstanding peripheral cantilevered flange of an outer panel member to overlie the peiphery of an inner panel member which is nested with said outer panel member to thereby join said outer panel member to said inner panel member, ssaid apparatus comprising:

a base plate;

means for supporting and holding said outer panel member and said inner panel member in spaced relationship to each other, said supporting and holding means being mounted to said base plate;

a cantilevered bracket attached to said supporting and holding means, said cantilevered bracket having one end wall attached to said supporting and holding means and at least one arm extending in a direction away from said one end wall, said at least one arm having a first pivot axis therein spaced a predetermined distance from said supporting and holding means, said cantilevered bracket further having at least one side wall complementary with said one end wall, said at least one side wall having a second pivot axis therein, said cantilevered bracket being mounted to said supporting and holding means so that said one end wall, at least one arm, at least one side wall are all fixed relative to said supporting and holding means;

a hemmer bracket adjacent said cantilevered bracket, said hemmer bracket having a first pivot axis substantially parallel to and spaced a predetermined distance from said first pivot axis of said at least one arm of said cantilevered bracket and a second pivot axis offset a predetermined radial distance from said second pivot axis of said at least one side wall;

a hemming steel attached to said hemmer bracket, said hemming steel facing said supporting and holding means in spaced apart juxtaposed relationship;

pivotable crank arm link means interposed said hemmer bracket and said at least one arm extending in a direction away from said one end wall, said pivotable crank arm link means having a third pivot axis at one end thereof coincident with said first pivot axis of said hemmer bracket such that said one end of said pivotable crank arm link means pivots about said first pivot axis of said hemmer bracket, said pivotable crank arm link means further having a fourth pivot axis located intermediate said one end and an opposite end, said fourth pivot axis being coincident with said first pivot axis of said at least one arm of said cantilevered bracket such that rotation of said pivotable crank arm link means about said first pivot axis of said hemmer bracket and said first pivot axis of said at least one arm urges said hemmer bracket to translate pivotably along a first substantially arcuate path about said second pivot axis of said hemmer bracket in a direction towards said peripheral cantilevered upstanding flange to perform a first stage hemming of said peripheral cantilevered upstanding flange whereby said peripheral cantilevered upstanding flange is folded over from a substantially upright position to a position approximately midway between said upstanding position and a final hemming position, said pivotable crank arm link means comprising:

a central shaft journaled to said at least one arm of said cantilevered bracket about said first pivot axis of said at least one arm;

a block member attached to said central shaft and extending towards said first pivot axis of said hemmer bracket;

a drag link member journaled about said first pivot axis of said hemmer bracket and extending towards said block member;

means for attaching said drag member to said block member;

an upper crank arm mounted to said central shaft in a direction away from said block member; and means for moving said upper crank arm in a pivotable movement, said moving means being attached to said upper crank arm such that said upper crank arm pivots said hemmer bracket in a direction towards and away from said supporting and holding means about said second pivot axis of said hemmer bracket to move said hemming steel over said midway position of said peripheral cantilevered upstanding flange;

oscillatable eccentric link means interposed said hemmer bracket and said at least one side wall of said cantilevered bracket, said oscillatable eccentric link means having a fifth pivot axis at one end thereof coincident with said second pivot axis of said at least one side wall, whereby said oscillatable eccentric link means translates pivotably about said second pivot axis of said at least one side wall of said cantilevered bracket;

said hemmer bracket being mounted to said oscillatable eccentric link means about said second pivot axis of said hemmer bracket such that oscillatory movement of said oscillatable eccentric link means moves said hemmer bracket in an arcuate motion about said second pivot axis of said at least one side wall, said oscillatable eccentric link means further comprising:

a first shaft mounted about said fifth axis of said oscillatable eccentric link means coincident with said second pivot axis of said at least one side wall; and a lower crank arm link attached to said first shaft for rotation therewith;

an axially extending eccentric shaft means mounted to said first shaft for rotation therewith, said axially extending eccentric shaft means coupled to said hemmer bracket so that a rotation of said axially extending eccentric shaft means causes an arcuate movement of said hemmer bracket;

a plurality of wear plates attached to said cantilevered bracket and a plurality of guide shoes attached to said hemmer bracket to provide lateral stability of said hemming steel; and means for moving said lower crank arm link in an oscillatory movement such that as said lower crank arm link oscillates said axially extending eccentric shaft means moves said hemmer bracket in an arcuate movement to lift said hemmer bracket in primarily a vertical direction with a minimum predetermined horizontal displacement;

whereby concurrent rotary movement of said oscillatable eccentric link means and said pivotable crank arm link means moves said hemming steel attached to said hemmer bracket to a position above said approximately midway position of said peripheral cantilevered upstanding flange such that a subsequent rotary movement of said oscillatable eccentric link means moves said hemming steel attached to said hemmer bracket in a downward motion to said final stage hemming position whereby said peripheral cantilevered upstanding flange overlies said inner panel member to hem said inner and outer panel members.

16. The apparatus of claim 15 wherein said means for supporting and holding said cantilevered bracket, and said hemmer bracket are weldments.

17. The apparatus of claim 15 further comprising a plurality of spacers and an L-shaped backup member that is an integral part of said hemmer bracket to reinforce said hemming steel.

18. The apparatus of claim 15 wherein said overall apparatus has a width that does not exceed the width of said means for supporting and holding or said hemming steel.

19. The apparatus of claim 15 wherein said lower crank arm link is comprised of two parts.

20. The apparatus of claim 19 wherein said lower crank arm link has lateral adjustment means.

21. The apparatus of claim 20 wherein said lateral adjustment means comprises a plurality of washers and retainers.

22. The apparatus of claim 15 further comprising adjustment means interposed between said drag link member and said upper crank arm.

23. The apparatus of claim 22 wherein said adjustment means comprises a tab attached to said drag link member and a tab attached to said block member and an adjustment screw positioned in one said tabs to control the proximity of said tabs to each other.

24. The apparatus of claim 15 wherein said plurality of guide shoes and said plurality of wear plates are of dissimilar metals.

25. The apparatus of claim 15 wherein said axially extending eccentric shaft, said drag link member, and said upper crank arm are journaled with a plurality of bearings.

* * * * *